US008347767B2

(12) United States Patent
Whitaker et al.

(10) Patent No.: US 8,347,767 B2
(45) Date of Patent: Jan. 8, 2013

(54) WRENCH FOR JAR-TOP VALVE COVERS

(76) Inventors: Mark Whitaker, McKinney, TX (US); Ruth Clifton, McKinney, TX (US)

( * ) Notice: Subject to any disclaimer, the term of this patent is extended or adjusted under 35 U.S.C. 154(b) by 0 days.

(21) Appl. No.: 13/055,483

(22) PCT Filed: Aug. 23, 2010

(86) PCT No.: PCT/US2010/046320

§ 371 (c)(1),
(2), (4) Date: Jan. 24, 2011

(87) PCT Pub. No.: WO2012/026917

PCT Pub. Date: Mar. 1, 2012

(65) Prior Publication Data

US 2012/0042755 A1 Feb. 23, 2012

(51) Int. Cl.
*B25F 1/00* (2006.01)

(52) U.S. Cl. ..... 81/437; 81/124.2; 81/120; 81/487; 81/176.2

(58) Field of Classification Search ..... 81/120, 81/176.1, 176.15, 176.2, 177.85, 52, 489–492, 81/121.1–125.1; D8/21–29, 40
See application file for complete search history.

(56) References Cited

U.S. PATENT DOCUMENTS 341,117 A * 5/1886 Wright ..... 7/138
613,652 A 11/1898 Chadbourne
1,222,411 A 4/1917 Kerfoot
1,321,776 A * 11/1919 Stepanian ..... 81/124.2
1,326,454 A 12/1919 Jones
1,875,836 A 9/1932 Wesolik
2,059,085 A 10/1936 Buck
2,519,204 A 8/1950 Sturm
D163,145 S * 5/1951 Scott ..... D8/40
2,629,415 A * 2/1953 Baker ..... 81/58.3
2,827,914 A * 3/1958 Alters ..... 137/364
3,797,286 A 3/1974 Saporito
4,064,902 A 12/1977 Swenson
4,572,236 A 2/1986 Baker
4,573,378 A 3/1986 McDonald
D293,197 S * 12/1987 Schumacher et al. ..... D8/18
4,836,065 A * 6/1989 Setliff ..... 81/124.2
5,003,848 A * 4/1991 Ceccucci, Jr. ..... 81/176.2
5,095,667 A 3/1992 Ryan et al.
(Continued)

OTHER PUBLICATIONS

International Search Report mailed by ISA/USA, U.S. Patent and Trademark Office on Oct. 14, 2010 for International Patent Application No. PCT/US10/46320.

*Primary Examiner* — Lee D Wilson
*Assistant Examiner* — Melanie Alexander
(74) *Attorney, Agent, or Firm* — James E. Walton; Damon R. Hickman

(57) ABSTRACT

A wrench for a valve includes an elongated member having a first end portion and a second end portion. A first leg and a second leg are attached to the first end portion. The first leg and the second leg extend at an angle with respect to each other to form a gap therebetween. The first leg and second leg both having an inner surface for engaging with an outer surface of a bonnet and both legs having a front surface for engaging with a side surface of a rib attached to the outer surface of the bonnet. The wrench also including a handle attached to the second end portion.

9 Claims, 6 Drawing Sheets

U.S. PATENT DOCUMENTS

| | | | | |
|---|---|---|---|---|
| 5,575,602 | A | 11/1996 | Savage et al. | |
| 5,946,990 | A | 9/1999 | Bonacci | |
| 5,983,925 | A | 11/1999 | Miller | |
| 6,176,157 | B1 * | 1/2001 | Ure | 81/124.2 |
| 7,036,402 | B1 * | 5/2006 | Marks et al. | 81/177.2 |
| 7,090,146 | B1 | 8/2006 | Ericksen et al. | |
| 7,100,476 | B1 | 9/2006 | Feit | |
| 7,322,563 | B2 | 1/2008 | Stehling et al. | |
| 2005/0284956 | A1 | 12/2005 | Mast | |
| 2007/0085047 | A1 | 4/2007 | Donovan | |

* cited by examiner

WRENCH FOR JAR-TOP VALVE COVERS

TECHNICAL FIELD

The present application relates generally to the field of wrenches and, more particularly, to wrenches adapted for irrigation systems.

DESCRIPTION OF THE PRIOR ART

Irrigation systems are well known in the art for effectively channeling water from a reservoir to a designated area, i.e., a household lawn, and include one or more of a plurality of conduits, valves, sprinklers, and other related devices.

Irrigation valves regulate water flowing through the irrigation system and are typically positioned within an underground housing. Irrigation valves are manufactured in different shapes and sizes, but share a common characteristic, namely, a conduit section for channeling water and a joint for opening and closing the conduit. Some irrigation valves include bonnets or similar devices for providing access to the inner cavity of the conduit for maintenance.

Removing the bonnet from the valve can be a difficult process due to the limited working space within the housing and because the bonnets become very tight and hard to remove over time. For at least these reasons, the worker will generally use pliers or other suitable means for removing the bonnet.

Tools, such as handheld pliers, are effective in removing the bonnet when ample space is provided within the underground housing. The pliers increase the gripping and torque forces applied to the bonnet, which allows a worker to disengage the bonnet from the valve. However, handheld pliers become ineffective in confined spaces. In some cases, it is necessary to excavate the area around the housing and remove the housing to obtain sufficient leverage to rotate the bonnet with conventional pliers.

A cup wrench is an alternative device for removing bonnets. The cup wrench includes a cup-shaped housing configured for fitting over the bonnet. The housing has a diameter slightly larger than the diameter of the bonnet. In operation, the worker places the housing over the bonnet such that the inner surface of the housing fits snuggly against the sides of the bonnet. Thereafter, the worker rotates the cup wrench, which in turn disengages the bonnet from the valve. As is shown in FIG. 1 of the drawings, solenoids, screws, wires and other devices are attached to the top surface of the bonnet, which increases the difficulty, if not making it impossible, to remove the bonnet with conventional cup wrenches. It should also be understood that a cup wrench has a fixed diameter adapted to fit on a bonnet having a particular diameter. The cup wrench is not configured to remove bonnets having different diameters.

Although the foregoing developments represent great strides in the area of wrenches for irrigation systems, many shortcomings remain.

BRIEF DESCRIPTION OF THE DRAWINGS

The novel features believed characteristic of the application are set forth in the appended claims. However, the application itself, as well as a preferred mode of use, and further objectives and advantages thereof, will best be understood with reference to the following detailed description when read in conjunction with the accompanying drawings, wherein:

Figure 1:
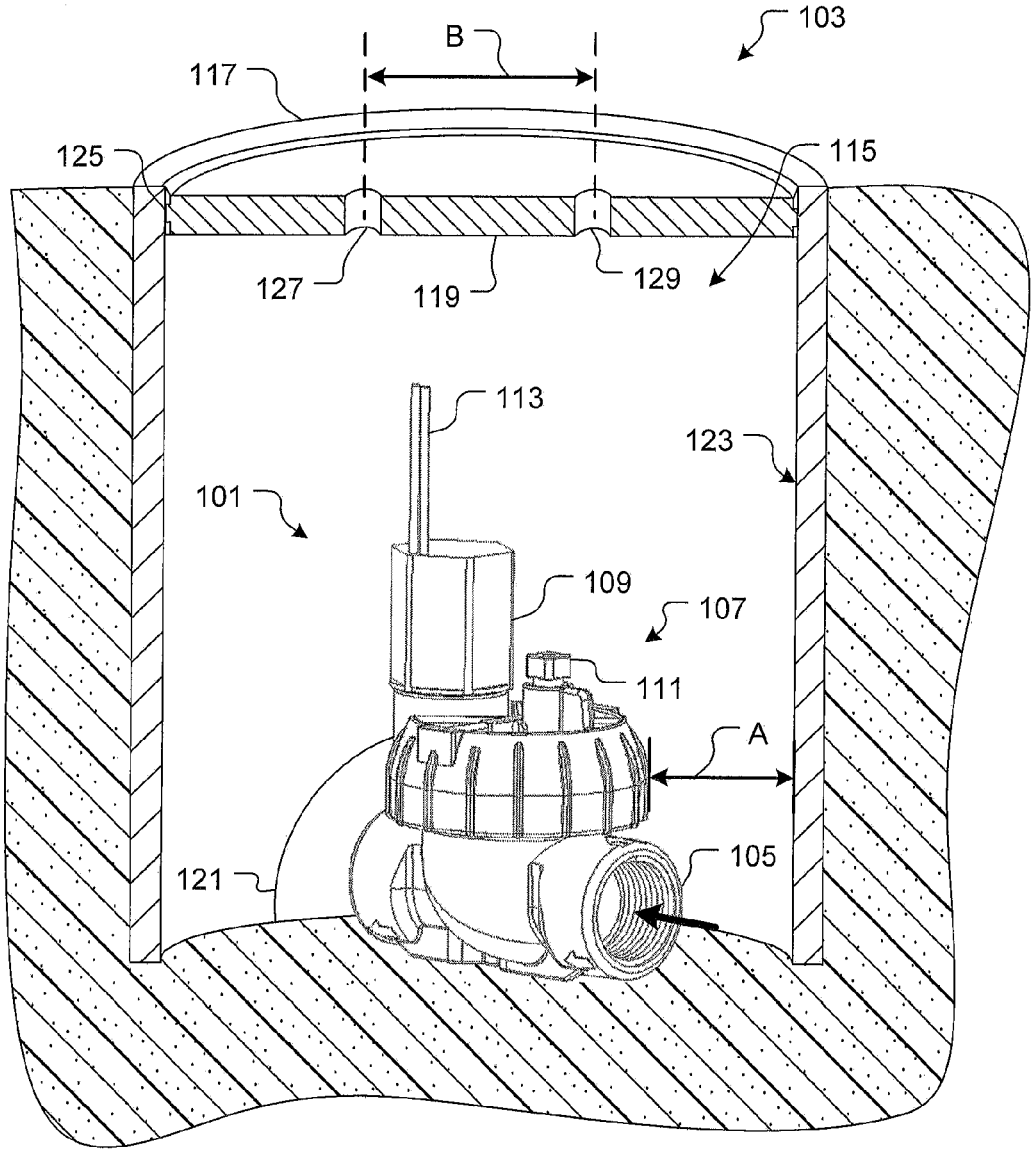
FIG. 1 (Prior Art)
FIG. 1 is an oblique view of a conventional valve positioned within an underground housing.

While the preferred embodiment of the present application is susceptible to various modifications and alternative forms, specific embodiments thereof have been shown by way of example in the drawings and are herein described in detail. It should be understood, however, that the description herein of specific embodiments is not intended to limit the invention to the particular embodiments disclosed, but on the contrary, the intention is to cover all modifications, equivalents, and alternatives falling within the spirit and scope of the preferred embodiment of the present application as defined by the appended claims.

DESCRIPTION OF THE PREFERRED EMBODIMENT

The wrench of the present application overcomes the disadvantages of conventional wrenches; specifically, the wrench comprises two or more legs adapted for engaging the bonnet, the legs provide the necessary gripping and torque means for effectively removing the bonnet in confined areas, the legs also extend at an angle with respect to each other, thereby forming a gap therebetween which receives bonnets having different diameters. The gap also allows the worker to quickly and easily maneuver the wrench around the various devices attached to the top surface of the bonnet, i.e., solenoids, screws, and wires. In addition, the wrench is a multipurpose tool further comprising a screwdriver bit and/or other devices attached thereto.

The wrench of the present application will be understood, both as to its structure and operation, from the accompanying drawings, taken in conjunction with the accompanying description. Several embodiments of the wrench are presented herein. It should be understood that various components, parts, and features of the different embodiments may be combined together and/or interchanged with one another, all of which are within the scope of the present application, even though not all variations and particular embodiments may be specifically illustrated in the drawings.

It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 in the drawings illustrates an oblique view of a conventional irrigation valve 101 positioned within an underground housing 103. Valve 101 regulates the flow of water channeled through the irrigation system (not shown), and in this particular embodiment, valve 101 is a Jar Top valve manufactured by Rain Bird®. It should be understood that the wrench of the present application could easily be adapted for other types of irrigation valves having similar characteristics as valve 101. Valve 101 comprises a conduit 105 and a joint or similar means (not shown) disposed within conduit 105 for opening and closing the water passage therethrough. Valve 101 is further provided with a bonnet 107 threadedly attached to conduit 105. Bonnet 107 provides access to the inner cavity of conduit 105, a feature particularly desired as a worker performs maintenance on valve 101.

Bonnet 107 is preferable threadedly attached to the top portion of conduit 105; however, alternative embodiments could include different means, i.e., a quick-release device or screws, in lieu of threads for attaching bonnet 107 to conduit 105. During maintenance, the worker rotates bonnet 107 to disengage bonnet 107 from conduit 105. The process of removing the bonnet can be difficult due to the limited working area within housing 103 and because bonnet 107 becomes very tight and hard to remove over time. For at least these reasons, the worker will typically use pliers or other suitable means for removing bonnet 107.

Various devices are attached to the top surface of bonnet 107. In this embodiment, solenoid 109 and screw 111 are attached to the top surface of bonnet 107 for regulating the flow of water channeled through conduit 105. One or more wires 113 are coupled to solenoid 109, which are conductively coupled to a control system (not shown) for controlling solenoid 109. It should be understood that solenoid 109, screw 111, and wires 113 increase the difficulty of removing bonnet 107 for conventional cup wrenches, as described above, because the solenoid, screw, and wires must fit within the cup housing before the worker can apply rotational movement on the bonnet. Further description and illustration of bonnet 107 are provided below with regard to FIG. 2.

Valve 101 and other components of the irrigation system, i.e., piping (not shown), are positioned within a cavity 115 formed by housing 103. The pipes, valves, wires, and other irrigation components disposed within cavity 115 decreases the working space therein, thus, increasing the difficulty of removing bonnet 107 from valve 101. Housing 103 comprises one or more of a side wall 117, a lid 119, and a port 121 for allowing pipes to enter and exit housing 103.

Wall 117 has an inner surface 123 that extends peripherally around valve 101. The distance between surface 123 and valve 101 is indicated with an arrow A. Distance A varies in alternative embodiments as additional valves, pipes, wires, and other irrigation components are positioned within housing 103, thereby increasing the difficulty of removing bonnet 107 from conduit 105 with conventional wrenches such as handheld pliers or cup wrenches.

Lid 119 is attached to an upper portion of wall 117 with a fastening means 125. In this embodiment, fastening means 125 comprises a rim extending around lid 119 that matingly engages with a groove within wall 117. The rim-groove embodiment allows the worker to rapidly remove lid 119 from housing 103. Lid 119 is further provided with a first hole 127 and a second hole 129 that extend through the thickness of lid 119 and are positioned at a distance B with respect to each other. Hole 127 and hole 129 allow the worker to easily pull lid 119 from housing 103. In operation, the worker simply positions a rod or similar means through the holes and applies a tilting and pulling force thereto, which in turn disengages fastening means 125. Lid 119 preferably comprises two holes; however, it should be appreciated that alternative embodiments could include lids having a single hole or lids having one or more holes that partially extend through the thickness of the lid.

Figure 2:
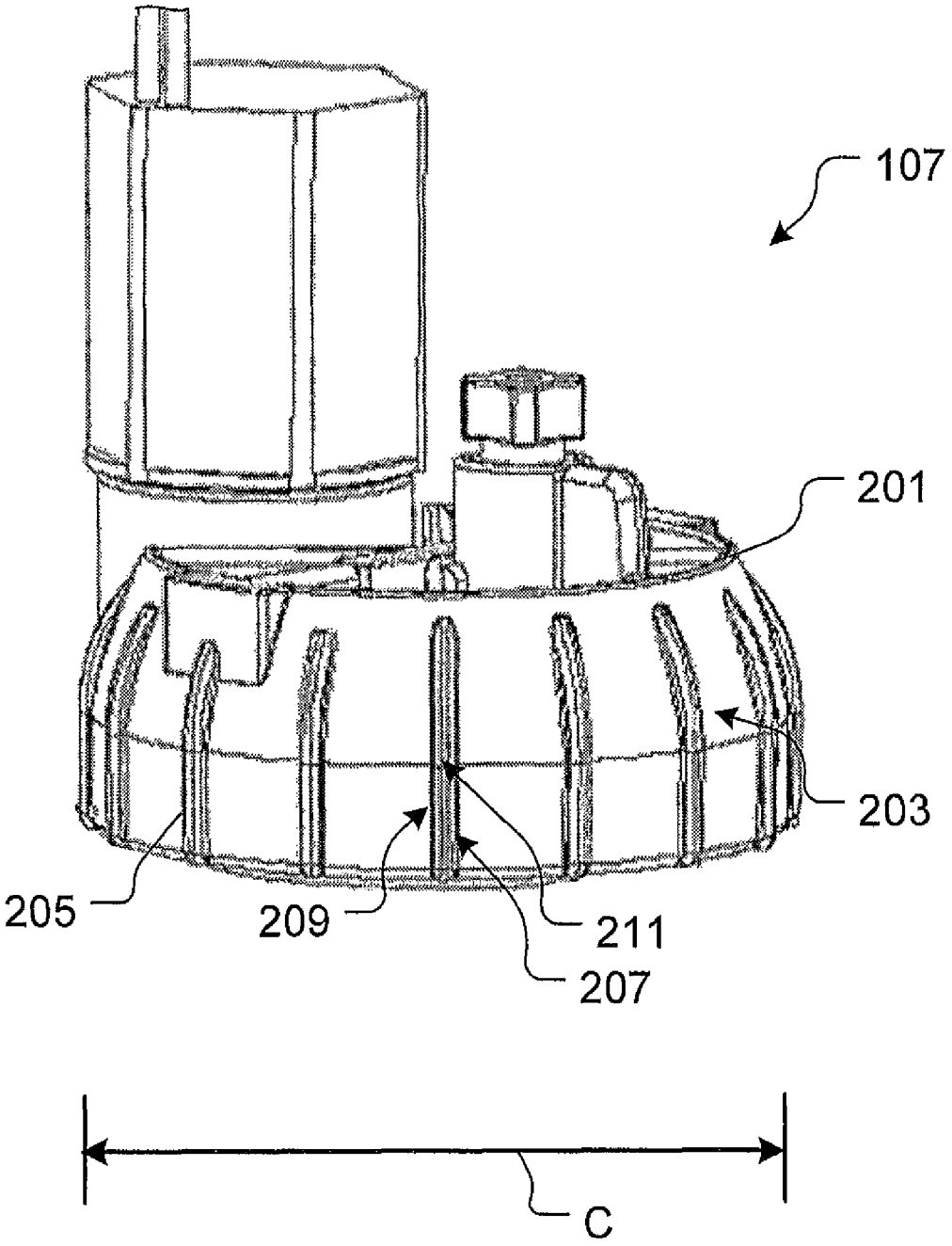
FIG. 2 (Prior Art)
FIG. 2 is an oblique view of a bonnet of the valve of FIG. 1.

FIG. 2 in the drawings illustrates an oblique view of bonnet 107. Bonnet 107 is manufactured with a circular body 201 having a diameter C and includes inner threads (not shown) for threading with outer threads of conduit 105. It should be understood that the wrench of the present application is readily adaptable for use with bonnets having different shapes and sizes, i.e., a bonnet having a square body in lieu of a circular body.

Body 201 includes an outer surface 203 and one or more of a rib 205 attached thereto. Rib 205 provide gripping means for removing body 201 from conduit 105 and are generally manufactured with three surfaces, a side surface 207, a side surface 209, and a top surface 211. It should be understood that conventional cup wrenches engage with top surface 211 for removing bonnet 107 from valve 101, while the wrench of the present application comprises two or more legs adapted to engage with outer surface 203 and side surface 209 for removing bonnet 107 from valve 101.

Figure 3:
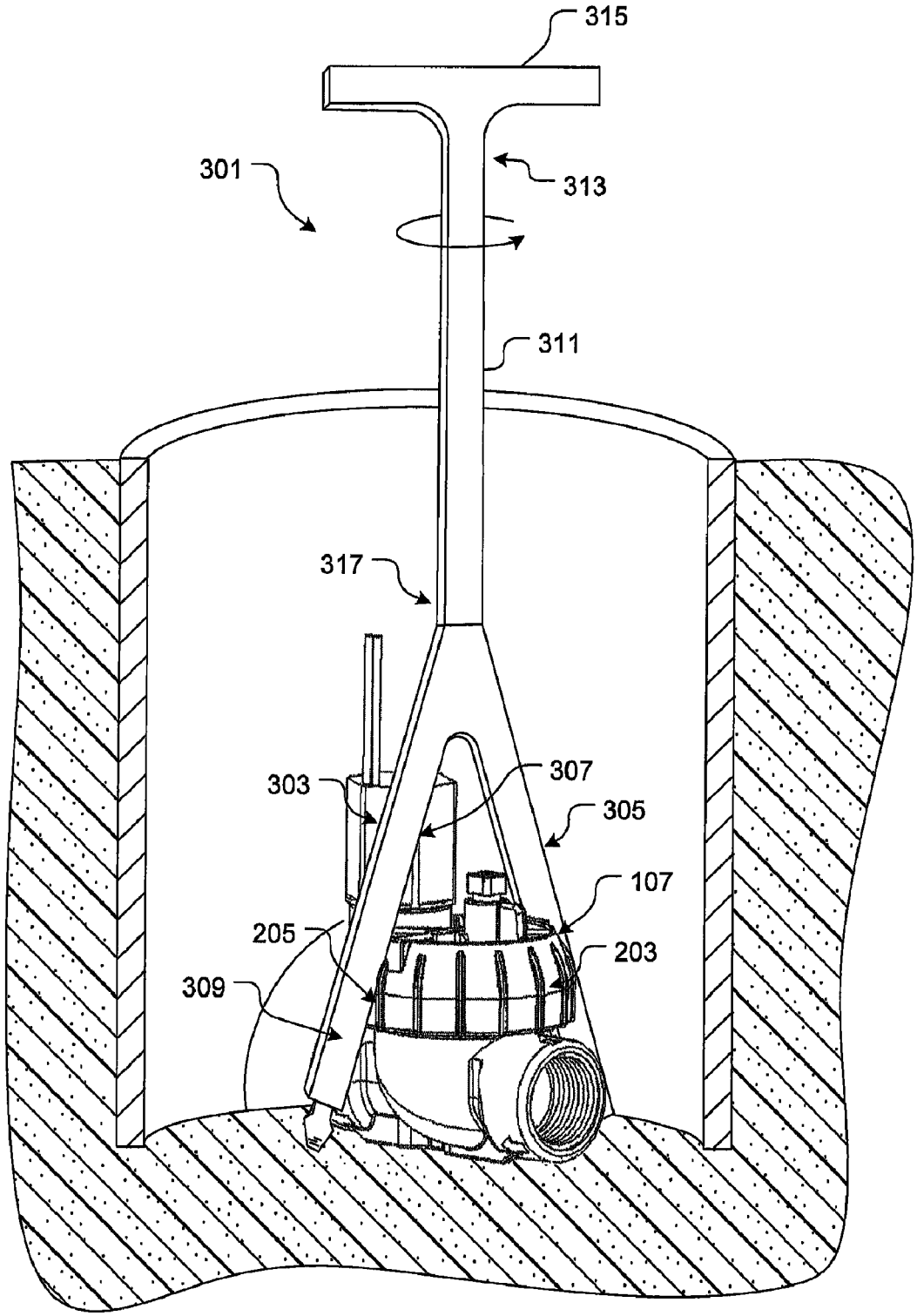
FIG. 3 is an oblique view of a wrench according to the preferred embodiment of the present application shown engaging the bonnet of FIG. 1.

FIG. 3 in the drawings illustrates an oblique view of a wrench 301 according to the preferred embodiment of the present application. Wrench 301 overcomes the disadvantages of conventional wrenches, namely, wrench 301 comprises a first leg 303 and a second leg 305 adapted for engaging bonnet 107, wherein leg 303 and leg 305 provide the necessary gripping and torque means for effectively removing bonnet 107 in the confined cavity 115. In addition, leg 303 and leg 305 extend at an angle with respect to each other, thereby allowing wrench 301 to engage with bonnets having different shapes and diameters. Leg 303 and leg 305 are preferable oriented at a 34 degree angle with respect to each other; however, it should be appreciated that alternative embodiments could include legs extending at different angles with respect to each other. The gap formed between leg 303 and leg 305 allows the worker to maneuver wrench 301 around solenoid 109, screw 111, and wires 113 positioned on the top surface of bonnet 107. In addition, wrench 301 is a multi-purpose tool further comprising one or more devices attached thereto.

Leg 303 and leg 305 include one or more surfaces for engaging bonnet 107, for example, leg 303 has an inner surface 307 adapted to fit snugly against surface 203 and a front surface 309 that engages with surface 209. In operation, leg 303 and leg 305 are pressed down against body 201 such that a tight fit is created therebetween, then the worker rotates wrench 301 such that surface 309 of leg 303 exerts a rotational force against rib 205, which in turn disengages bonnet 107 from valve 101. Likewise, the worker can repeat the operational process by applying a counter-rotational movement, thereby tightening bonnet 107 to valve 101. Wrench 301 preferably comprises two legs; however, it should be appreciated that alternative embodiments could include more or less legs for disengaging the bonnet from the valve.

Wrench 301 is further provided with an elongated member 311 having two end portions, a first end portion 313 attached to a handle 315 and a second end portion 317 attached to leg 303 and leg 305. Wrench 301 is preferably manufactured as a single body comprising member 311, handle 315, leg 303, and leg 305; however it should be appreciated that alternative embodiments could include detachable components, i.e., a detachable handle, in lieu of the preferred embodiment. Wrench 301 is preferably composed of a metallic material such as an iron alloy; however, it should be appreciated that alternative embodiments could include different materials such as wood, composite, plastic, or other suitable materials in lieu of the preferred metallic material.

Figure 4A:
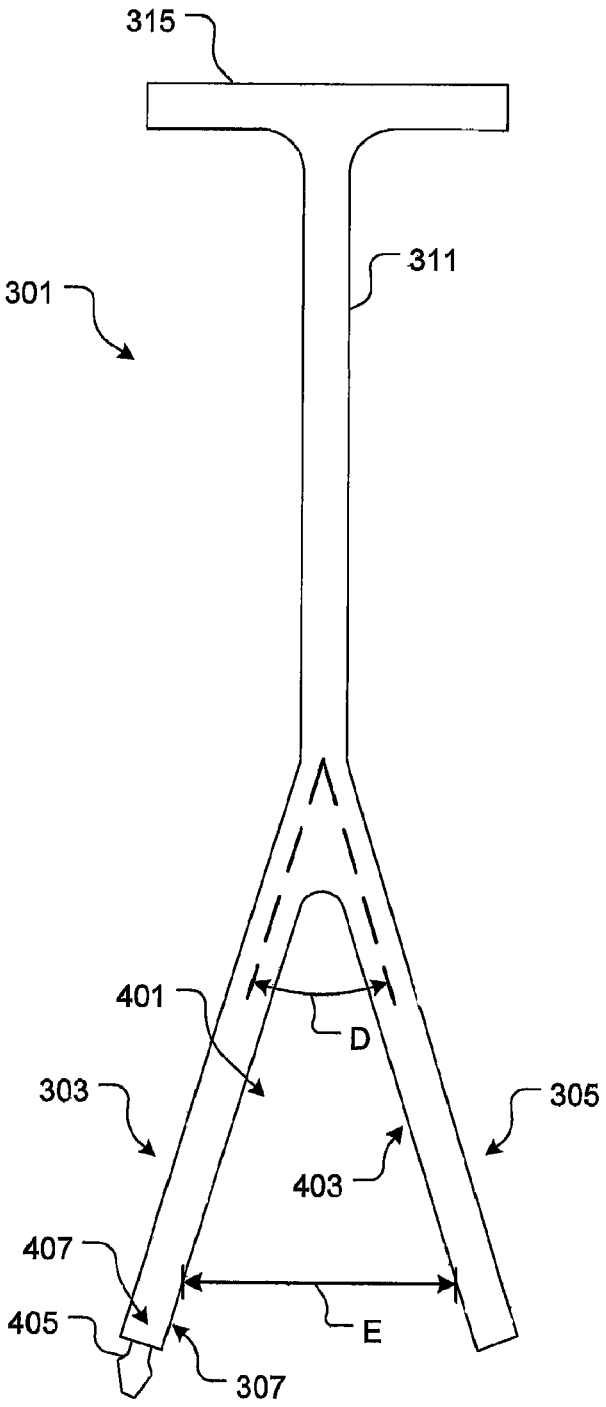
FIG. 4A is a front view of the wrench of FIG. 3.
Figure 4B:
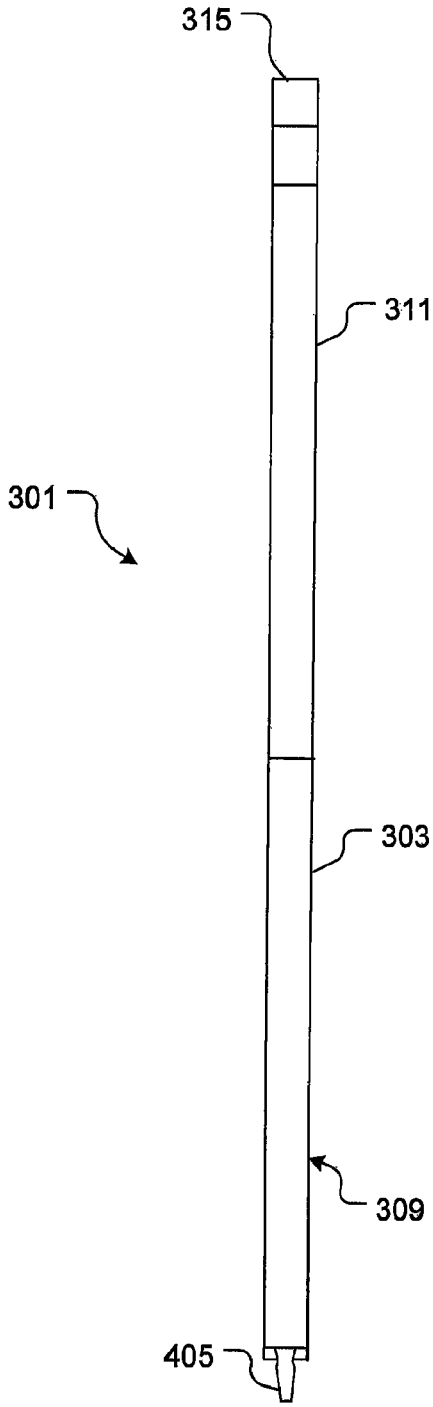
FIG. 4B is a right view of the wrench of FIG. 4A.

FIG. 4A illustrates a front view of wrench 301, while FIG. 4B illustrates a right view of wrench 301. Leg 303 and leg 305 extend at an angle D with respect to each other, which forms gap 401 therebetween. Gap 401 allows the user to easily maneuver wrench 301 around solenoid 109, screw 111, and wires 113 attached to the top surface of bonnet 107. An arrow E indicates the distance between the inner surface 307 of leg 303 and a surface 403 of leg 305. Inner surface 307 and inner surface 403 are adapted to fit snuggly against surface 203 of bonnet 107. The distance E varies along the length of leg 303 and leg 305, which allows wrench 301 to engage bonnets having different diameters.

Wrench 301 is further provided with a flat head screwdriver bit 405 securely fastened to end portion 407 of leg 303. Screwdriver bit 405 is preferably rigidly attached to wrench 301; however, it should be appreciated that alternative embodiments could include attachment means for coupling bit 405 to leg 303. For example, an alternative embodiment could include a quick-release device attached to leg 303 that interlocks with the screwdriver bit, thereby allowing the worker to switch between different types of fasteners and devices used with irrigation systems.

FIG. 4B illustrates a right view of wrench 301. Leg 305 includes a surface 409 for contact with side surface 209 of rib 205 during tightening of bonnet 107 to valve 101. In operation, leg 303 and leg 305 are pressed down against body 201 such that a tight fit is created therebetween, then the worker counter-rotational force such that surface 409 of leg 305 exerts a rotational force against surface 209 of rib 205, which in turn tightens bonnet 107 to valve 101.

Wrench 301 is preferably manufactured with a ½ inch square stock material; however, it should be appreciated that alternative embodiments could include materials having different sizes and geometric profiles, i.e., a bar stock material having a ½ inch circular cross-sectional profile. The preferred square stock material maximizes the contact surfaces between wrench 301 and bonnet 107.

Figure 5:
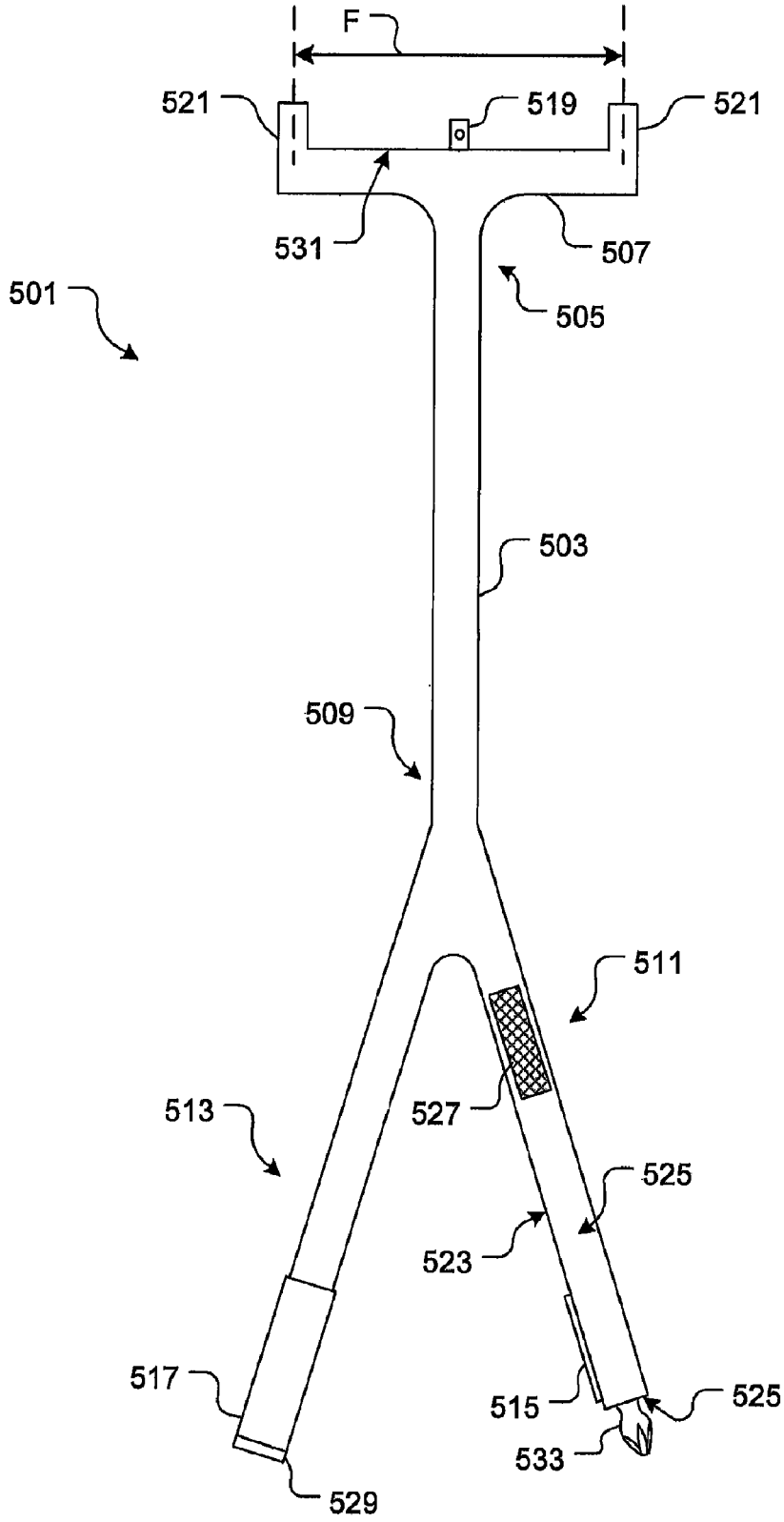
FIG. 5 is a front view of an alternative embodiment of the wrench of FIG. 3.

FIG. 5 illustrates an alternative embodiment of wrench 301. Wrench 501 is substantially similar in form and function to wrench 301. Wrench 501 comprises an elongated member 503 having two end portions, a first end portion 505 attached to a handle 507 and a second end portion 509 attached to a leg 511 and a leg 513. Wrench 501 is further provided with a gripping material 515, an extension 517, a socket adapter 519, and two posts 521.

Gripping material 515 provides additional contact friction between leg 511 and surface 203 of bonnet 107. Gripping material 515 is shown attached to inner surface 523 of leg 511; however, it should be appreciated that gripping material 515 could be attached to any surface of wrench 501, including a front surface 525 for providing additional friction between leg 511 and side surface 207 of bonnet 107. Gripping material 515 is preferably manufactured with an adhesive and/or elastomeric material; however, it should be appreciated that alternative embodiments could include different types of materials, i.e., a composite material, in lieu of the preferred material.

Wrench 501 preferably includes a treated surface 527 for providing additional gripping during operation. Treated surface 527 can include groves, knurls, etches, dimples, and/or other suitable surface treatments. Treated surface 527 is shown applied to leg 511; however, it should be appreciated that treated surface 527 could be applied to any surface of wrench 501.

Wrench 501 is further provided with a Phillips screwdriver bit 529 securely fastened to surface 531 of leg 511. Screwdriver bit 529 is preferably rigidly attached to wrench 501; however, it should be appreciated that alternative embodiments could include attachment means for coupling bit 529 to leg 511. For example, an alternative embodiment could include a leg having a quick-release device that interlocks with the screwdriver bit, thereby allowing the worker to fasten other types of fasteners and devices used with irrigation systems.

Extension member 517 increases the length of leg 513 and preferably includes a fastening means 533 attached to extension member 517 for fastening with various types of fasteners and devices, i.e., a screwdriver bit, socket adapter, a magnet, or an Allen wrench.

Socket adapter 519 is preferably attached to an upper surface 535 of handle 507 and provides fastening means for devices and fasteners used with irrigation systems. For example, sockets, long screwdrivers, or a housing for a cup wrench (see FIG. 6) could fasten to socket adapter 519. Handle 507 is further provided with one or more posts 521 spaced apart by a distance F and adapted for removing lid 119 from housing 103. Posts 521 are configured for fitting within hole 127 and hole 129 of lid 119, thus, distance F is equal to distance B, as depicted in FIG. 1. In operation, the worker places posts 521 through hole 127 and hole 129 and applies rotational and tilting movement thereto, which in turn disengages lid 119 from wall 117. It should be understood that that posts 521 could be easily used with different embodiments having holes that do not extend through the thickness of lid 119. For example, alternative embodiments of lid 119 could include holes that partially extend through the thickness of lid 119. In these embodiments, the worker can manipulate wrench 501 with posts 521 such that posts 521 interlock with one or more holes, thereby allowing the worker to apply a bending force thereto to disengage lid 119 from housing 103.

Figure 6:
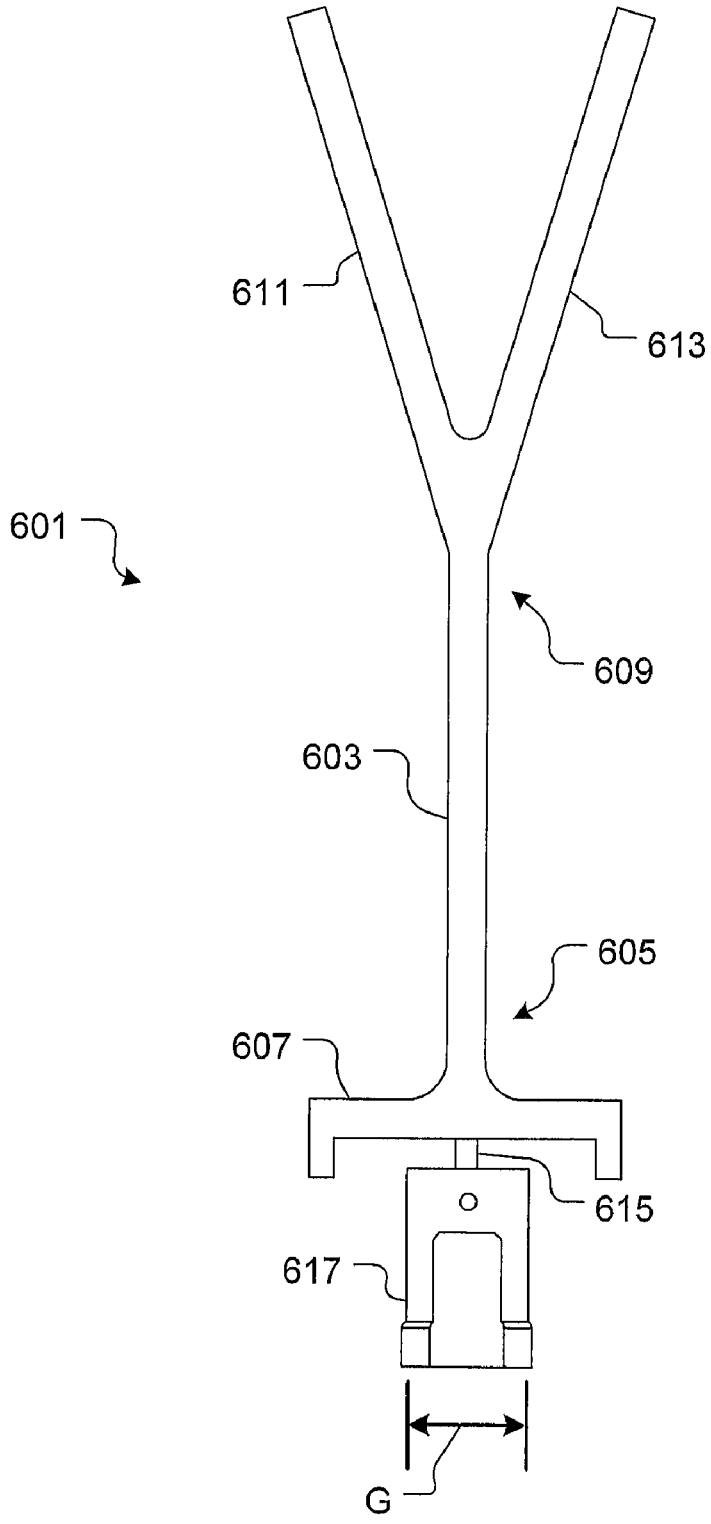
FIG. 6 is a front view of an alternative embodiment of the wrench of FIG. 3.

FIG. 6 illustrates an alternative embodiment of wrench 301. Wrench 601 is substantially similar in form and function to wrench 301. Wrench 601 comprises an elongated member 603 having two end portions, a first end portion 605 attached to a handle 607 and a second end portion 609 attached to a leg 611 and a leg 613. Wrench 601 is further provided with a socket adapter 615 or similar means for coupling with a cup housing 617.

Cup housing 617 has an inner diameter G, which is slightly larger than diameter C of bonnet 107. During operation, the worker positions housing 617 on bonnet 107 such that the inner surfaces of housing 617 snugly fit against surface 211 of rib 205, then the worker rotates wrench 601, which in turn disengages bonnet 107 from valve 101.

It is evident by the foregoing description that the wrench for an irrigation system has significant benefits and advantages, including: (1) two or more legs adapted for engaging the bonnet, the legs providing the necessary gripping and torque means for effectively removing the bonnet in confined areas; (2) the legs extending at an angle with respect to each for removing bonnets having different shapes and diameters; (3) the legs forming a gap therebetween so as to easily maneuver around devices attached to the top of the bonnet; and (4) the wrench being a multi-purpose tool further comprising devices and fasteners attached thereto for working on irrigation system components.

The particular embodiments disclosed above are illustrative only, as the invention may be modified and practiced in different but equivalent manners apparent to those skilled in the art having the benefit of the teachings herein. It is therefore evident that the particular embodiments disclosed above may be altered or modified, and all such variations are considered within the scope and spirit of the invention. Accordingly, the protection sought herein is as set forth in the description. It is apparent that an invention with significant advantages has been described and illustrated. Although the present invention is shown in a limited number of forms, it is not limited to just these forms, but is amenable to various changes and modifications without departing from the spirit thereof.

The invention claimed is:

1. A wrench for a valve having a bonnet, the bonnet having a body with an outer surface and a rib attached to and extending from the outer surface, the rib having a side surface, the wrench comprising:

an elongated member having:

a first end portion and an opposing second end portion;

a t-shaped handle attached to the first end portion;

a first leg attached to the second end portion, the first leg having:

a rigid rectangular shape and a front surface and an inner surface;

a second leg having a rigid rectangular shape;

the second leg attached to the second end portion, the first leg and the second leg extend away from the second end at a non-zero angle with respect to each other, thereby forming a gap, the gap being unobstructed between the first leg and the second leg, so as to permit the bonnet to engage the first leg along the inner surface from the second end to an end portion of the first leg; and a fastener which has a detachable end and a tapered plate attached to a second end opening of the first leg;

wherein the inner surface of the first leg engages the outer surface of the bonnet and the front surface of the first leg engages the side surface of the rib during removal of the bonnet from the valve.

2. The wrench according to claim 1, wherein the fastener is a screw driver bit.

3. The wrench according to claim 2, further comprising:

an extension member coupled to the first leg.

4. The wrench according to claim 1, further comprising:

a socket adapter attached to the handle.

5. The wrench according to claim 4, further comprising:

a cup housing coupled to the socket adapter.

6. The wrench according to claim 1, further comprising:

a first post attached to a first end of the handle extending in a direction relatively orthogonal to the length of the handle; and a second post attached to a second end of the handle extending in a direction relatively orthogonal to the length of the handle.

7. The wrench according to claim 1, further comprising:

a quick-release device coupled to the first leg to allow for selective interchangeability of the fastener.

8. A method for disengaging a bonnet threadedly attached to a valve positioned in an underground housing, the bonnet having a body with an outer surface and a rib attached to and extending from the outer surface, the rib having a side surface, the method comprising:

providing a wrench having an elongated member including a t-shape handle being attached to a first leg and attached to a second leg, the first leg and the second leg extend away from the second end at a non-zero angle with respect to each other, thereby forming a gap, the first leg and the second leg being non-parallel from the second end to an end portion of the first leg wherein a fastener has a detachable end and a tapered plate attached, the gap being unobstructed between the first leg and the second leg, so as to permit the bonnet to engage the first leg along the inner surface from the second end to an end portion of the first leg;

locating the wrench over the bonnet until the bonnet engages the inner surface, thereby creating a tight fit there between;

rotating the wrench, such that a front surface of the first leg contacts the side surface of the rib, thereby disengaging the bonnet from the valve.

9. The method according to claim 8, further comprising:

providing a handle attached to the elongated member, the handle having a first post coupled to a first end of the handle;

engaging the first post with a lid in communication with the housing, the lid being releasably coupled the housing;

applying a turning force to the elongated member, thereby disengaging the lid from the housing; and removing the lid from the housing.

* * * * *